US006394295B2

(12) United States Patent
Claude

(10) Patent No.: US 6,394,295 B2
(45) **Date of Patent: *May 28, 2002**

(54) CONTAINER HAVING SNAP FIT CAP DISENGAGEABLE BY ROTATION

(75) Inventor: Isabelle Claude, Le Plessy Robinson (FR)

(73) Assignee: L'Oreal, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/039,392

(22) Filed: Mar. 16, 1998

(30) Foreign Application Priority Data

Mar. 14, 1997 (FR) ..... 97 03116

(51) Int. Cl.[7] ..... B65D 41/17

(52) U.S. Cl. ..... 215/318; 215/295; 215/354; 215/45

(58) Field of Search ..... 215/318, 317, 215/295, 321, 354, 341, 343, 344, 45, 44

(56) References Cited

U.S. PATENT DOCUMENTS

| | | | | |
|---|---|---|---|---|
| 1,386,729 A | * | 8/1921 | Ramsey | 215/317 |
| 2,069,075 A | * | 1/1937 | Linn | 215/295 |
| 2,193,226 A | | 3/1940 | Deletzke | |
| 3,223,269 A | * | 12/1965 | Williams | 215/318 |
| 3,372,834 A | | 3/1968 | Ayotte et al. | |
| 3,430,798 A | * | 3/1969 | Goyet et al. | 215/295 |
| 3,910,444 A | * | 10/1975 | Foster | 215/295 |
| 4,967,921 A | * | 11/1990 | Pre et al. | 215/295 |
| 5,715,960 A | * | 2/1998 | Seymour | 215/318 X |

FOREIGN PATENT DOCUMENTS

| | | |
|---|---|---|
| AT | 304 290 A | 12/1972 |
| DE | 21 30 098 A | 12/1972 |
| GB | 1 000 641 A | 8/1965 |
| GB | 1 260 128 | 1/1972 |
| WO | WO 9321079 A | 10/1993 |

* cited by examiner

*Primary Examiner*—Stephen P. Garbe
*Assistant Examiner*—Robin A Hylton
(74) *Attorney, Agent, or Firm*—Oblon, Spivak, McClelland, Maier & Neustadt, P.C.

(57) ABSTRACT

A container (1) includes a body (2) and a cap (20). At least one elastically deformable portion (26, 27) of the cap has a set of beading (17, 18) capable of interacting with a snap-fit edge (6) provided on the neck. A first ramp (6, 16, 11) causes, in response to a rotational movement of the cap (20) with respect to the body (2), an axial displacement of the set of beading (17, 18) along the snap-fit edge (6) between a bottom position and a top position, and a second ramp (6, 16, 11) simultaneously causes the set of beading (17, 18) to part radially so as to allow the set of beading, when in the top position, to pass over the snap-fit edge (6) under the effect of an elastic return force exerted by the elastically deformable portion (26, 27).

40 Claims, 3 Drawing Sheets

CONTAINER HAVING SNAP FIT CAP DISENGAGEABLE BY ROTATION

BACKGROUND OF THE INVENTION

1. Field of the Invention

The present invention relates to a container, especially of the tube, bottle, pot or some other type, onto which a closure cap is removably snap-fitted. The container according to the invention is suited to the packaging of products of a liquid to pasty consistency, and especially to the packaging of cosmetic, household, pharmaceutical or other products.

2. Description of the Related Art

FIG. 1 illustrates a conventional container onto which a cap 101 is removably snap-fitted. The container comprises a body surmounted by a neck 102, one end of which has a free edge defining an opening for dispensing the product. A snap-fit bead 103 in the form of a set of beading is arranged on the exterior surface of the neck in the vicinity of its end opposite the free edge. The exterior surface also has, above the snap-fit bead 103, an edge 104 which forms a projection with respect to the surface of the neck and defines a ramp consisting of two diametrically opposed crests 105, 106 separated by two troughs 107, which are also diametrically opposed.

The cap 101 has a transverse wall 109 closing one end of an exterior lateral skirt 110. Arranged concentrically inside the lateral skirt are two skirt portions 115, 116 (in the form of two tabs), the interior surface of which, in the vicinity of their free end, carries two diametrically opposed beading 112, 113 capable of interacting by snap-fitting with the snap-fit bead 103. The cap has at least one fin 111, the free end of which is designed to rest on the ramp formed by the edge 104.

The cap is closed by snap-fitting the beadings 112, 113 over the bead 103 when the free end of the fin 111 is facing a trough of the ramp. To open the cap, it is turned with respect to the container, which causes the free end of the fin 111 to ride up the ramp and exerts an axial pulling force on the beading 112, 113, which axial pulling force causes the sets of beading to pass over the bead when the free end of the fin 111 comes more or less to a crest of the ramp, and this occurs by elastic deformation of the free end of the skirt portions 115, 116. Sealing of the closure is provided by a sealing skirt 117, of an outside diameter which is slightly smaller than the inside diameter of the neck of the container.

A configuration of this kind has the drawback of causing the cap to open abruptly when the sets of beading pass over the snap-fit bead, and this may allow product to come out unintentionally. What is more, the opening motion requires a high torque in order to both make the stud ride up the ramp and cause the sets of beading to pass over the snap-fit bead.

SUMMARY OF THE INVENTION

Thus, one of the objects of the invention is to provide a container sealed by a cap snap-fitted to a container, and which does not have the drawbacks mentioned hereinabove.

A further object of the invention is to provide a device which can be operated more smoothly, particularly as regards opening the cap.

Other objects of the invention will emerge in detail in the description which follows.

According to a feature of the invention, these objects are achieved by producing a container having a body and means for removably receiving a cap, at least one elastically deformable portion of which has at least one set of beading capable of interacting with a snap-fit edge provided on the said means, wherein the means comprise a first ramp which, in response to a rotational movement of the cap with respect to the body of the container, causes an axial displacement of the set (or sets) of beading along the snap-fit edge between a bottom position and a top position, and a second ramp which, at the same time as the said axial displacement, causes the set (or sets) of beading to part radially so as to allow the set (or sets) of beading, when this (or these) are in the top position, to pass over the snap-fit edge under the effect of an elastic return force exerted by the elastically deformable portion and allow the container to be opened, the cap being snap-fitted over the bead when the set (or sets) of beading is (or are) in the bottom position.

Thus, according to the invention, the sets of beading pass over the edge, so that the cap can be opened, at a different point from where the sets of beading pass over the snap-fit edge for closing the cap. The motion of opening is made easier by the presence of the two ramps, one of which directs the cap upwards, while the other causes the set or sets of beading to part radially, so as to allow the snap-fit edge to be passed.

According to one embodiment, the snap-fit edge consists of a bead of material projecting from the exterior surface of the neck. Alternatively, the snap-fit edge consists of the upper edge of a portion which is reentrant with respect to the outside surface of the neck.

Advantageously, the means consists of a neck surmounting the container, and having a free edge, the snap-fit edge and the first and second ramps being arranged on an exterior surface of the neck, the set (or sets) of beading being arranged on an internal surface of the elastically deformable portion of the cap.

Advantageously too, the snap-fit edge forms a first profile consisting of an alternation of troughs and of crests spaced uniformly on the periphery of the neck, a lower edge being provided beneath the snap-fit edge, the said lower edge forming a second profile consisting of an alternation of troughs and of crests aligned angularly with the troughs and crests of the snap-fit edge and delimiting with the snap-fit edge a groove forming the said first ramp, and the axial height of which, at least in the vicinity of the troughs exceeds the axial height of the sets of beading so as to define enough space to accommodate the said sets of beading when the cap is snap-fitted, the said groove guiding the sets of beading in the top position when there is a movement of relative rotation between the cap and the body of the container.

According to a preferred embodiment, the second ramp is formed by a progressive reduction in the axial height of the groove towards the crests, the said axial height of the groove in the vicinity of the said crests being appreciably less than the axial height of the sets of beading, so that rotating the cap with respect to the body of the container causes the set or sets of beading to part with respect to the bottom of the groove, so as to allow the sets of beading to pass over the snap-fit edge when the said sets of beading are in the top position. This solution is particularly advantageous on account of the ease of achieving it. What is more, the groove allows the sets of beading to be better guided as the cap is rotated with respect to the body of the container.

Advantageously, the edge provided beneath the snap-fit edge consists of the upper surface of a bead similar to the snap-fit bead, projecting from the exterior surface of the neck, but its distance from the snap-fit bead varies along the periphery of the neck. Such beads of material can be produced by molding, when the container is molded.

According to another embodiment, the second ramp is formed by a progressive reduction in the depth of the groove in the direction of the crests so as to cause the said sets of beading to part radially in the vicinity of the crests, thus allowing the sets of beading to pass over the said snap-fit edge. This characteristic is particularly advantageous in that it allows greater suppleness and flexibility in producing the respective profiles of the snap-it edge and the set of beading itself.

Advantageously, the lower edge situated beneath the snap-fit edge is, at least in the vicinity of the crests of the said first and second profiles, of an outside diameter that exceeds the outside diameter of the snap-fit edge. This makes it possible to appreciably reduce the risk of the sets of beading accidentally passing over the edge which lies beneath the snap-fit bead, especially on opening, while making it easier for the sets of beading to be ejected upwards. On closure, this risk can be avoided through a suitable choice of the axial height of the cap portions that carry the sets of beading.

The ejection of the sets of beading over the snap-fit bead is made easier by a suitable choice of the profile for the lower edge, and possibly for the snap-fit edge in the vicinity of the crests. Advantageously, the edge situated beneath the snap-fit edge has a rounded surface or a surface which is inclined in the direction away from the free edge of the neck.

Two consecutive crests and two consecutive troughs of the said first and second profiles may be spaced apart angularly by 180° so that passage from the bottom position to the top position takes place by rotating the cap through 90° with respect to the body of the container.

Alternatively, each of the said first and second profiles has just one crest and just one trough which are offset angularly by 180°, so that passage from the bottom position to the top position takes place by rotating the cap through 180° with respect to the body of the container.

More specifically, the cap may comprise: a) a transverse wall closing a first end of an external lateral skirt, the second end being open; and b) at least one portion of an internal skirt with an inside diameter that exceeds the maximum outside diameter of the neck, the said portion of internal skirt being concentric with the external lateral skirt, and on its internal surface bearing two diametrically opposed sets of beading capable of interacting with the snap-fit edge when the cap is fitted on the container.

By way of example, the said sets of beading are arranged respectively on the internal surface of two diametrically opposed elastically deformable tabs.

The container can be sealed, when closed, by means of a sealing skirt with an outside diameter slightly smaller than the inside diameter of the neck of the container, and concentric with the internal skirt portions and the external lateral skirt.

BRIEF DESCRIPTION OF THE DRAWINGS

Apart from the provisions set out hereinabove, the invention consists in a certain number of other provisions which will be explained hereinbelow in connection with non-limiting embodiments described with reference to the appended figures, among which.

DETAILED DESCRIPTION OF THE PREFERRED EMBODIMENTS

Figure 1:
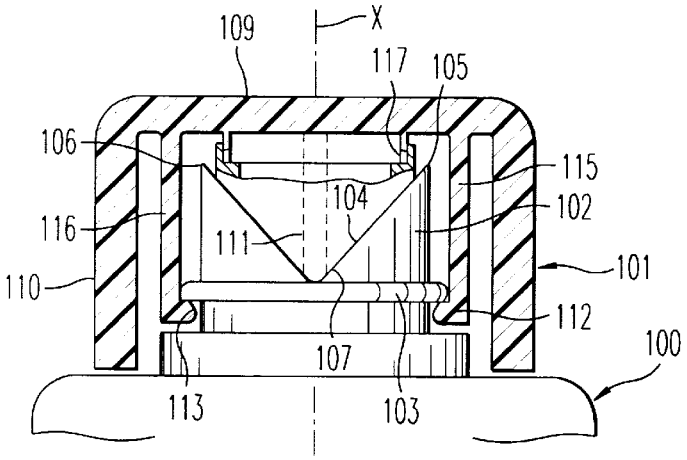
FIG. 1 PRIOR ART
FIG. 1 illustrates a sectional view through a conventional container.
Figure 2:
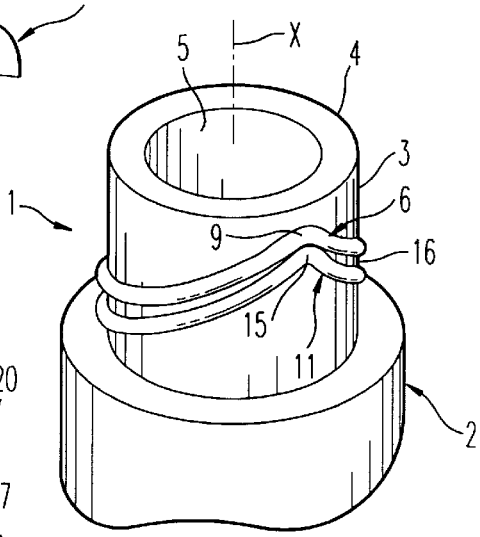
FIGS. 2 to 4 illustrate a first embodiment of the container according to the invention.
Figure 3:
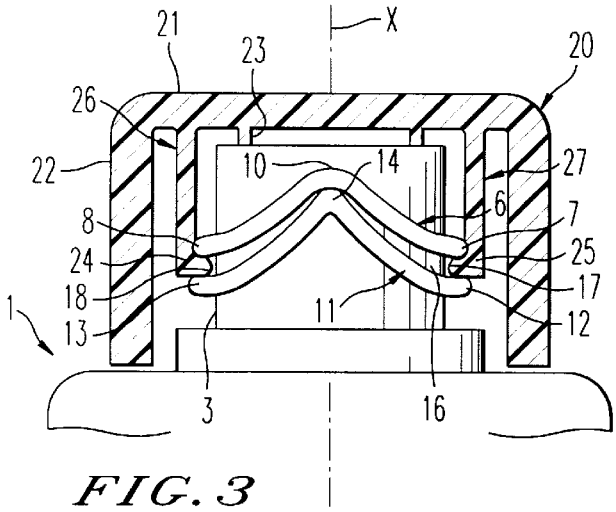
Figure 4:
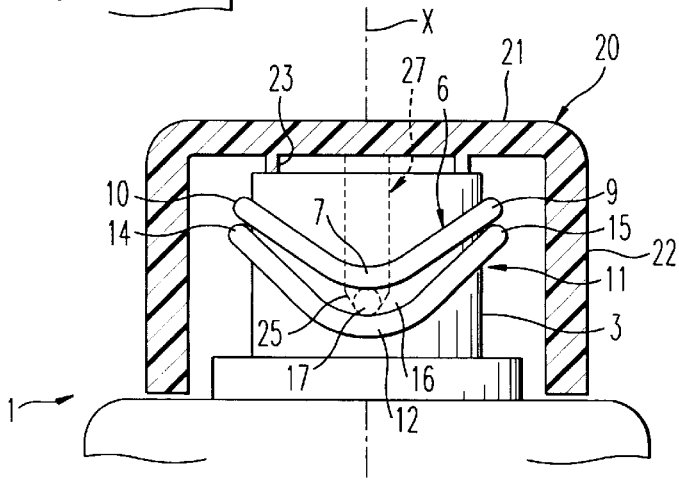

FIGS. 2 to 4 illustrate a first embodiment of the container 1 according to the invention. This container comprises a body 2, which may or may not be cylindrical, in the form of a pot, a bottle, or a tube, one end of which is welded along a closure line, or in any other shape. The body 2 is surmounted by a neck 3 of a cross-section that is smaller than the cross-section of the body 2, and which has a free edge 4 delimiting an opening 5 for extracting the product. The exterior surface of the neck 3 has an elongate snap-fit edge in the form of a bead of material 6 projecting from the exterior surface of the neck 3. The axial profile of the snap-fit edge 6 is undulating. That is, it consists of an alternation of troughs 7, 8 and crests 9, 10 spaced uniformly on the exterior periphery of the neck 3. Arranged beneath the snap-fit bead 6 is a second bead of material 11, also formed of an alternation of troughs 12, 13 and crests 14, 15, aligned angularly with the troughs and crests respectively of the snap-fit bead 6. The two beads are offset axially so as to delimit between the lower edge of the snap-fit bead 6 and the, upper edge of the second bead 11 a groove 16 the axial height of which, in the vicinity of the troughs 7, 8, 12, 13, exceeds the axial height of the snap-fit beading or studs 17, 18 carried by the cap 20, so that they can receive by snap-fitting, preferably with a bit of clearance, the beading 17, 18. The two beads 6 and 11 become closer together as they near the crests 9, 10, 14, 15 so that the axial height of the groove 16 they delimit will, in the vicinity of the crests, be less than the axial height of the beading 17, 18. In practice, near the crests, the two beads are more or less contiguous, at least at their bases.

The container 1 is closed removably by a cap 20 having a transverse wall 21 closing a first end of a lateral skirt 22, the height of which is more or less equal to that of the neck 3. The transverse wall carries a sealing skirt 23, the outside diameter of which is slightly smaller than the inside diameter of the neck 3 and which is capable of sealing the closure of the container 1. Alternatively, sealing is provided by means of a block of foam bonded to the internal surface of the transverse wall 21 and capable of resting against the free edge 4 of the neck when the cap is fitted on said neck 3.

Arranged between the lateral skirt 22 and the sealing skirt 23 are two tabs 26, 27 forming two portions of a cylindrical skirt concentric with the lateral skirt 22 and the sealing skirt 23. The two tabs are diametrically opposed and have free ends 24, 25, respectively, the internal surfaces of which carry a snap-fit beading or stud 18, 17 respectively. The ends of the tabs have a certain elasticity so as to allow the sets of beading 17, 18 to pass over the snap-fit edge 6.

The container and the cap are preferably made by molding a thermoplastic material. Typically, use is made of polyethylenes, polypropylenes, polyvinyl chlorides, polystyrenes or complexes containing such materials. Other materials or mixtures of such materials can be used.

Figure 5A:
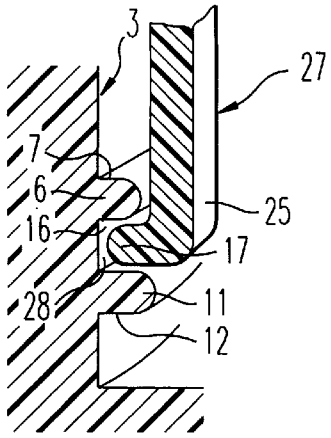
FIGS. 5A to 5E, illustrate the opening of the container in accordance with FIGS. 2 to 4.

FIGS. 5A to 5E diagrammatically illustrate the operation, upon closure and opening, of the container shown in FIGS. 2 to 4. FIG. 5A shows the beads 6 and 11, and the beading 17 in axial section at one of the troughs 7, 12 (the beading 18 works in a corresponding way). The position illustrated in FIG. 5A corresponds to the closed position. At this point, the axial height of the groove 16 exceeds the axial height of the beading 17, which means that the latter is housed with some degree of clearance in the bottom of the groove 16. The beading 17 is brought into a snap-fit position, either directly or after the cap has been rotated with respect to the container, with the upper edge of the bead 6 guiding the sets of beading 17, 18 towards the troughs 7, 8 as the cap is rotated. Such rotation is necessary if the beading 17, 18 have rested at a crest or in an intermediate position on the snap-fit bead.

When the sets of beading are in this position, the cap is snap-fitted onto the neck by exerting pressure on the transverse wall of the cap, which causes elastic deformation of the free end of the tabs 26, 27 and so causes the sets of beading 17, 18 to part radially. By continuing to exert pressure of this kind, the sets of beading pass over the bead 6. Once they have passed over the bead, the sets of beading become lodged in the bottom of the groove 16, under the effect of the elastic return force generated by the deformation of the tabs 26, 27, and axially (within the clearance) immobilize the cap on the neck. The force needed to snap-fit the cap on the neck varies widely according to the respective profile of the sets of beading 17, 18 and the snap-fit bead 6.

Figure 5B:
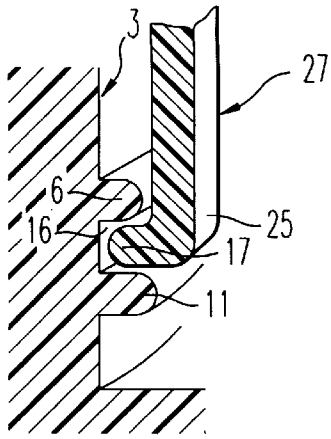
Figure 5C:
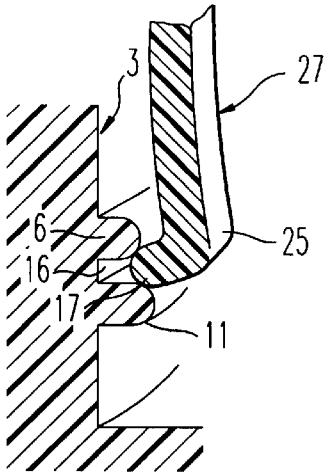

FIG. 5B is a view in section, in a slightly different angular position to the position of FIG. 5A. By turning the cap with respect to the body of the container (for example clockwise), the beading 17, guided in the groove 16, rides up along the snap-fit bead 6 with a movement that has mainly axial and angular components. The axial height of the groove at this point is more or less identical to the axial height of the beading 17.

By continuing to turn the cap with respect to the body (FIG. 5C), the set of beading continues to ride up along the snap-fit bead 6 while guided in the groove 16, the axial height of which is now less than the axial height of the beading 17. The free edge of the beading 17 is no longer in contact with the bottom of the groove and the tab 27 is elastically deformed outwards. Thus, the movement of the set of beading now has a radial component in addition to the axial component and the angular component.

Figure 5D:
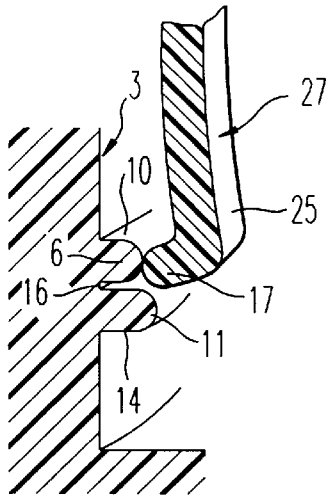

In FIG. 5D, the beading 17 substantially reaches a crest 10, 14 of the groove 16. At this point, the two beads 6 and 11 are substantially contiguous at their base, the elastic deformation of the tab 27 is at its maximum, and the free end of the set of beading rests unstably on the free edges of the beads 6 and 11. In this embodiment, the maximum outside diameter of bead 11 exceeds the maximum outside diameter of the snap-fit bead 6 so as to prevent the sets of beading 17 and 18 from passing over the bead 11. At this point, the sets of beading are "ejected" over the bead 6 under the effect of the elastic return force generated by the tabs 26, 27, which force has a component both radial and axial, towards the free edge 4 of the neck 3.

Figure 5E:
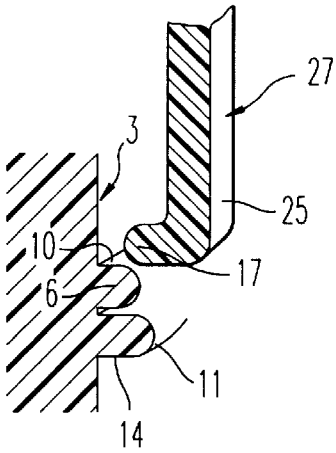

In FIG. 5E, the sets of beading 17 and 18 have passed over the snap-fit bead 6. The tabs 26 and 27 have reverted by elastic return force to their non-deformed position. The cap can then be removed to give access to the dispensing orifice 5.

Figure 6A:
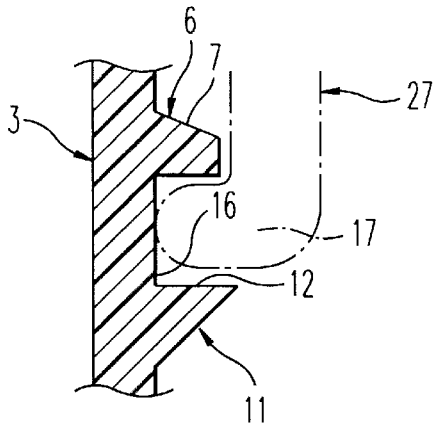
FIGS. 6A to 6D illustrate alternate versions of the container according to the invention.

FIGS. 6A–6D illustrate various alternate profiles of the snap-fit edge 6 and the edge 11 which delimit the groove 16. In FIG. 6A, close to a trough 7, 12, the snap-fit bead 6 has an angular profile to ensure that the cap is held firmly on the container. In this configuration, the snap-fit bead 6 has a cross-section (in a plane passing through the axis X of the container) which is more or less rectangular, but with the upper edge slightly inclined towards the body of the container so as to make ii; easier for the sets of beading 17, 18 to pass over the bead. The bead 11 beneath the snap-fit bead 6 has an outside diameter that slightly exceeds the outside diameter of the snap-fit bead, so as to prevent the sets of beading 17 and 18 from accidentally passing over the bead 11 when the cap is snap-fitted to the neck 3.

In this embodiment, in the vicinity of a trough, the lower edge of the snap-fit bead 6 and the upper edge of the bead 11 are more or less perpendicular to the axis of the bottle, thus giving a very tight closure. A profile of this kind would be impossible to achieve in the conventional snap-fitting systems in which the cap is snap-fitted onto the neck and is removed at the same point on the snap-fit bead because it is impossible, simply by pulling, to pass over a bead with a profile of this kind. According to the invention, the cap is snap-fitted onto the neck in an angular position that differs from the angular position in which the cap is removed. Thus, by producing a changing profile, especially for the snap-fit bead, it is possible both to ensure that the cap is held on firmly when closed, and that the cap can be gently removed. By way of example, the profile of the snap-fit bead in the bottom position is as depicted in FIG. 6A, then changes towards the adjacent crests to have a rounded or pointed cross-section (see FIG. 6B) in the vicinity of the crests, thus making it easier for the cap to be ejected over the snap-fit edge 6.

Figure 6B:
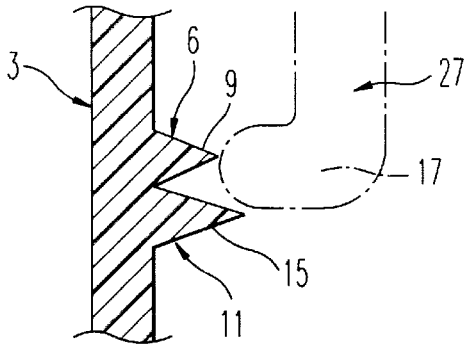
Figure 6C:
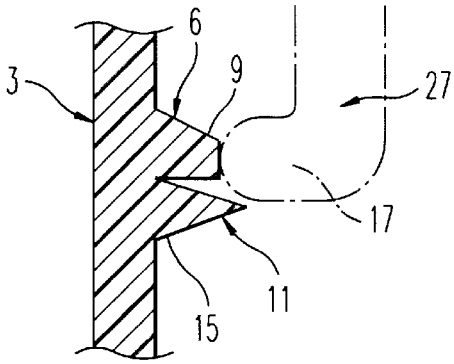
Figure 6D:
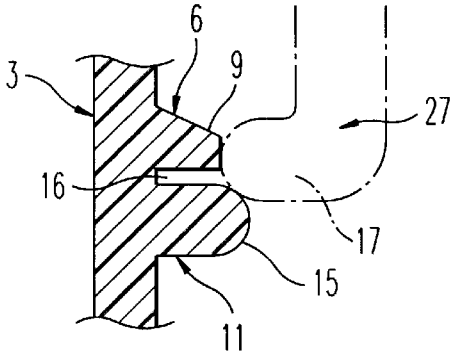

FIGS. 6B–6C illustrate axial sections at one of the crests 9, 15 of the beads 6 and 11. In FIG. 6B, the two beads, in the vicinity of the crests, are of triangular cross-section, the maximum diameter of the bead 11 being slightly greater than the maximum diameter of the bead 6 so as to encourage the beading 17 to be ejected over the snap-fit bead 6. In the embodiment of FIG. 6C, the bead 11 has a cross-section identical to the cross-section of the bead 11 in FIG. 6B. The snap-fit bead 6 has a similar cross-section to the cross-section of the snap-fit bead depicted in FIG. 6A. In the embodiment of FIG. 6D, the bead 11 has a cross-section with a radius or is rounded. In practice, the shape of the beads 6 and 11 is chosen appropriately to suit, in particular, the desired smoothness of opening and the firmness with which the cap is to be held on the neck when closed. As mentioned earlier, the cross-sections of the beads 6 and 11 may change between a trough and a crest. By way of example, the snap-fit bead 6 may, in the vicinity of a trough, have a cross-section like the one depicted in FIG. 6A, then change towards the crests to be of a similar cross-section to the one depicted in FIG. 6B. The same is true of the bead 11 situated beneath the snap-fit bead 6.

Figure 6E:
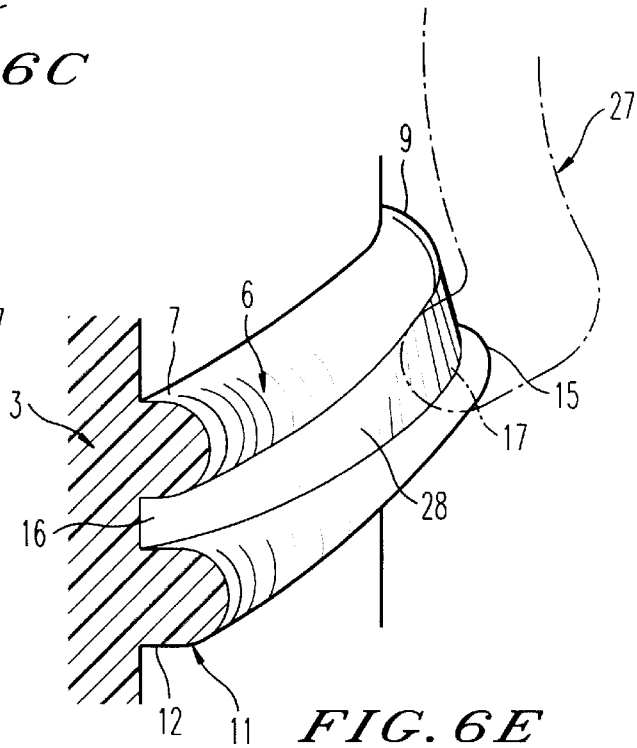
FIG. 6E illustrates another version of the container according to the invention.

FIG. 6E illustrates an alternative version of the container according to the invention. In this version, the sets of beading are parted radially on opening, not by a reduction in the axial height of the groove 16 towards the crests but by varying the depth of the groove 16 towards the crests. For this, the neck has a thickness that varies between the bead 6 and the bead 11, the depth of the groove in the vicinity of a trough 7, 12 being enough to retain the beading 17 or 18, then diminishing progressively towards a crest 9, 15 so as to cause the free end of the tab 27 carrying the set of beading 17 to part radially and be ejected over the snap-fit beading 6, near the crest 9, 15. In the embodiment depicted in FIG. 6E, the bottom 28 of the groove 16 is slightly twisted to make it more or less parallel to the axis of the container in the vicinity of a trough 7, 12 and to make it slightly inclined towards the snap-fit bead 6 in the vicinity of the crest 9, 15. This twisting of the bottom 28 of the groove 16 encourages ejection of the set of beading 17 or 18 over the snap-fit bead 6 when the set of beading reaches the crest 9, 15. In this embodiment, the snap-fit bead 6 also has a maximum outside diameter slightly smaller than the maximum outside diameter of the bead 11.

In the embodiment depicted in FIGS. 2 to 4, the snap-fit edge has two diametrically opposed crests and two troughs, which are also diametrically opposed, which means that the opening of the cap is the result of the cap being rotated by a quarter of a turn with respect to the body. It is obvious that other configurations can be envisaged. By way of example, the snap-fit bead has just one crest and just one trough, these being diametrically opposed, so that opening is the result of the cap being rotated by half a turn with respect to the body of the container. Still other angles of opening are possible according to the invention, depending in particular on the diameter of the neck. Likewise, in the embodiments discussed earlier, the snap-fit edge and the lower edge with which it delimits the groove 16 are edges which project from the external surface of the neck 3. It is obvious that these edges can consist of edges that are reentrant with respect to the exterior surface of the neck.

In the foregoing detailed description, reference was made to preferred embodiments of the invention. It is obvious that variations can be made thereon without departing from the spirit of the invention as claimed hereinafter.

What is claimed:

1. A container comprising:

a body having an end portion with an opening through which the contents of the body may pass and a peripheral surface having a snap-fit edge, wherein at least a part of said snap-fit edge extends in a direction having a component in an axial direction of the body;

a cap cooperable with said end portion to close the opening, and having at least one elastically deformable portion having at least one beading engageable with said snap-fit edge to retain the cap on the body;

a first ramp on the end portion, the first ramp being at least in part defined by said snap fit edge and extending in a direction such that rotation of the cap relative to the body causes axial movement of the at least one beading along said snap-fit edge; and a second ramp on the end portion and cooperating with said first ramp, the second ramp being at least in part defined by said snap fit edge and extending in a direction such that the rotation of the cap to a certain position causes the at least one beading to move radially to disengage from said snap-fit edge and permit removal of the cap from the body.

2. The container according to claim 1, wherein said end portion comprises a neck having a free edge, said snap-fit edge and said first and second ramps arranged on an exterior surface of said neck, the at least one beading being mounted on an internal surface of the elastically deformable portion of the cap.

3. The container according to claim 2, wherein the snap-fit edge forms a first profile having an alternation of troughs and crests spaced uniformly on the periphery of the neck, further comprising a lower edge beneath the snap-fit edge, the lower edge forming a second profile having an alternation of troughs and of crests aligned angularly with the troughs and crests of the snap-fit edge and delimiting with the snap-fit edge a groove forming said first ramp, wherein the axial height of the groove, at least in the vicinity of the troughs, exceeds the axial height of the at least one beading to define a space able to accommodate said beading in the groove, the groove guiding the beading to the certain position, which comprises one of the crests.

4. The container according to claim 3, wherein the second ramp comprises a progressive reduction in the axial height of the groove towards the crests such that the axial height of the groove in the vicinity of the crests is less than the axial height of the beading, so that rotating the cap with respect to the body causes the beading to separate from a bottom of the groove and to pass over the snap-fit edge when the beading is at the certain position.

5. The container according to claim 3, wherein the second ramp is formed by a progressive reduction in the depth of the groove in the direction of the crests, to cause the beading to move radially in the vicinity of the crests and allow the beading to pass over the snap-fit edge.

6. The container according to claim 3, wherein said lower edge, at least in the vicinity of the crests, has an outside diameter that exceeds an outside diameter of the snap-fit edge.

7. The container according to claim 3, wherein the snap-fit edge and the lower edge, in the vicinity of the troughs, extend substantially perpendicular to an axis of the container.

8. The container according to claim 3, wherein a profile of at least one of the snap-fit edge and the lower edge changes between said troughs and said crests such that the cap is held firmly when the beading is at a trough and is able to disengage from the snap-fit edge when the beading is at a crest.

9. The container according to claim 3, wherein the lower edge has, in the vicinity of the crests, a surface comprising means for inducing the beading to pass over the snap-fit edge.

10. The container according to claim 9, wherein the lower edge has one of a rounded surface and a surface which is inclined in the direction away from the free edge of the neck.

11. The container according to claim 3, wherein two consecutive ones of said crests and two consecutive ones of said troughs are spaced apart angularly by 180°, whereby the beading can pass from a trough to a crest upon a cap rotation of 90° with respect to the body.

12. The container according to claim 3, wherein each of said first and second profiles has exactly one crest and exactly one trough which are offset angularly by 180°, whereby the beading can pass from a trough to a crest upon a cap rotation of 180° with respect to the body.

13. The container according to claim 2, wherein the cap comprises an external lateral skirt having an open end, and a transverse wall closing an end of the skirt opposite the open end, and an internal skirt having a portion having an inside diameter that exceeds the maximum outside diameter of the neck, said portion of the internal skirt being concentric with the external lateral skirt and bearing two diametrically opposed ones of the beading on its internal surface.

14. The container according to claim 13, wherein said sets of beading are arranged respectively on the internal surface of two diametrically opposed tabs.

15. The container according to claim 13, further comprising a sealing skirt on said transverse wall, said sealing skirt having an outside diameter smaller than an inside diameter of the neck, and being concentric with the internal skirt portion and the external lateral skirt.

16. The container according to claim 3, wherein said snap-fit edge and said lower edge project from an external surface of the neck.

17. The container according to claim 16, wherein said snap-fit edge and said lower edge are comprised of two beads molded with the container.

18. A container comprising:

a body having an end portion with an opening through which the contents of the body may pass and a peripheral surface having an undulating snap-fit edge;

a cap cooperable with said end portion to close the opening, and having at least one elastically deformable portion having at least one beading engageable with said snap-fit edge to retain the cap on the body;

a first ramp on the end portion, the first ramp being located adjacent said snap fit edge and extending in a direction such that rotation of the cap relative to the body causes axial movement of the at least one beading along said snap-fit edge; and a second ramp on the end portion, the second ramp being located adjacent said snap fit edge and extending in a direction such that the rotation of the cap to a certain position causes the at least one beading to move radially to disengage from said snap-fit edge, whereby said first and second ramps cooperate to permit removal of the cap from the body.

19. The container according to claim 18, wherein said end portion comprises a neck having a free edge, said snap-fit edge and said first and second ramps arranged on an exterior surface of said neck, the at least one beading being mounted on an internal surface of the elastically deformable portion of the cap.

20. The container according to claim 19, wherein the snap-fit edge forms a first profile having an alternation of troughs and crests spaced uniformly on the periphery of the neck, further comprising a lower edge beneath the snap-fit edge, the lower edge forming a second profile having an alternation of troughs and of crests aligned angularly with the troughs and crests of the snap-fit edge and delimiting with the snap-fit edge a groove forming said first ramp, wherein the axial height of the groove, at least in the vicinity of the troughs, exceeds the axial height of the at least one beading to define a space able to accommodate said beading in the groove, the groove guiding the beading to the certain position, which comprises one of the crests.

21. The container according to claim 20, wherein the second ramp comprises a progressive reduction in the axial height of the groove towards the crests such that the axial height of the groove in the vicinity of the crests is less than the axial height of the beading, so that rotating the cap with respect to the body causes the beading to separate from a bottom of the groove and to pass over the snap-fit edge when the beading is at the certain position.

22. The container according to claim 20, wherein the second ramp is formed by a progressive reduction in the depth of the groove in the direction of the crests, to cause the beading to move radially in the vicinity of the crests and allow the beading to pass over the snap-fit edge.

23. The container according to claim 20, wherein said lower edge, at least in the vicinity of the crests, has an outside diameter that exceeds an outside diameter of the snap-fit edge.

24. The container according to claim 20, wherein the snap-fit edge and the lower edge, in the vicinity of the troughs, extend substantially perpendicular to an axis of the container.

25. The container according to claim 20, wherein a profile of at least one of the snap-fit edge and the lower edge changes between said troughs and said crests such that the cap is held firmly when the beading is at a trough and is able to disengage from the snap-fit edge when the beading is at a crest.

26. The container according to claim 20, wherein the lower edge has, in the vicinity of the crests, a surface comprising means for inducing the beading to pass over the snap-fit edge.

27. The container according to claim 26, wherein the lower edge has one of a rounded surface and a surface which is inclined in the direction away from the free edge of the neck.

28. The container according to claim 20, wherein two consecutive ones of said crests and two consecutive ones of said troughs are spaced apart angularly by 180°, whereby the beading can pass from a trough to a crest upon a cap rotation of 90° with respect to the body.

29. The container according to claim 20, wherein each of said first and second profiles has exactly one crest and exactly one trough which are offset angularly by 180°, whereby the beading can pass from a trough to a crest upon a cap rotation of 180° with respect to the body.

30. The container according to claim 19, wherein the cap comprises an external lateral skirt having an open end, and a transverse wall closing an end of the skirt opposite the open end, and an internal skirt having a portion having an inside diameter that exceeds the maximum outside diameter of the neck, said portion of the internal skirt being concentric with the external lateral skirt and bearing two diametrically opposed sets of the beading on its internal surface.

31. The container according to claim 30, wherein said sets of beading are arranged respectively on the internal surface of two diametrically opposed tabs.

32. The container according to claim 30, further comprising a sealing skirt on said transverse wall, said sealing skirt having an outside diameter smaller than an inside diameter of the neck, and being concentric with the internal skirt portion and the external lateral skirt.

33. The container according to claim 20, wherein said snap-fit edge and said lower edge project from an external surface of the neck.

34. The container according to claim 33, wherein said snap-fit edge and said lower edge are comprised of two beads molded with the container.

35. A container comprising:

a body having an end portion with an opening through which the contents of the body may pass and a peripheral surface having an undulating snap-fit edge;

a cap cooperable with said end portion to close the opening, and having at least one elastically deformable portion having at least one beading engageable with said snap-fit edge to retain the cap on the body; and means for causing axial and radial movement of the at least one beading along said snap-fit edge upon rotation of the cap relative to the body.

36. A container comprising:

a body having an end portion with an opening and a peripheral surface having an undulating snap-fit edge;

a cap cooperable with said end portion to close the opening, and having at least one beading engageable with said snap-fit edge to retain the cap on the body; and a guiding mechanism, said guiding mechanism comprising a groove configured to guide said at least one beading along said snap-fit edge in an axial direction of said body and in a radial direction of said body upon rotation of the cap relative to the body.

37. The container according to claim 36, wherein said groove is disposed on said body.

38. The container according to claim 36, wherein said groove is an undulating groove.

39. The container according to claim 38, wherein said undulating groove has a depth at a crest of said undulating groove which is shallower than the depth at a lower portion of said undulating groove.

40. The container according to claim 39, wherein said groove is disposed between said snap-fit edge and a bead disposed on said body.

* * * * *